US006647582B1

(12) United States Patent
Rechelbacher

(10) Patent No.: US 6,647,582 B1
(45) Date of Patent: Nov. 18, 2003

(54) STRESS RELIEVING GEL HANDLE BRUSH

(75) Inventor: Horst Martin Rechelbacher, Osceola, WI (US)

(73) Assignee: Aveda Corporation, Blaine, MN (US)

( * ) Notice: Subject to any disclaimer, the term of this patent is extended or adjusted under 35 U.S.C. 154(b) by 0 days.

(21) Appl. No.: 09/500,551

(22) Filed: Feb. 9, 2000

Related U.S. Application Data

(60) Provisional application No. 60/119,239, filed on Feb. 9, 1999.

(51) Int. Cl.[7] ..... A46B 5/02

(52) U.S. Cl. ..... 15/143.1; 16/421; 15/160

(58) Field of Search ..... 15/160, 143.1, 15/206; 16/421, 422, 431

(56) References Cited

U.S. PATENT DOCUMENTS 1,963,360 A 7/1934 Gibbin et al.
2,205,769 A * 6/1940 Sweetland
4,044,625 A * 8/1977 D'Haem
4,167,192 A * 9/1979 Arnold
4,386,620 A 6/1983 Handler
4,617,697 A * 10/1986 David
4,964,192 A * 10/1990 Marui
5,000,599 A 3/1991 McCall et al.
5,327,611 A 7/1994 Balster et al.
5,355,552 A * 10/1994 Huang
D389,651 S 1/1998 Chan et al.
5,781,958 A 7/1998 Messmann et al.
5,887,600 A * 3/1999 Wilk
5,956,796 A * 9/1999 Lodato
5,970,581 A * 10/1999 Chadwick
6,049,936 A * 4/2000 Holley

FOREIGN PATENT DOCUMENTS

FR 1323750 7/1963

* cited by examiner

*Primary Examiner*—Randall E. Chin
(74) *Attorney, Agent, or Firm*—Karen A. Lowney; Peter M. Giancana

(57) ABSTRACT

The invention relates to a hairbrush comprising a head region and a handle region, the handle region comprising a stem, the stem having a deformable grip located thereon.

8 Claims, 2 Drawing Sheets

STRESS RELIEVING GEL HANDLE BRUSH

This application claims the benefit of U.S. Provisional Application No. 60/119,239, filed Feb. 9, 1999.

FIELD OF THE INVENTION

The invention relates to hairstyling tools. More specifically, the invention relates to hairstyling tools that are ergonomically designed for enhanced ease of use.

BACKGROUND OF THE INVENTION

A typical hairstyling tool, such as a comb or brush, is designed of hard plastic material or of wood. The hardness of the material is in many ways a benefit, because it withstands the pulling or tugging that is often required in brushing or combing hair. It is, however, hard on the hand of the user, and can make the process of hairstyling more arduous or difficult than it might otherwise be. The present invention now provides for a means for rendering the process of combing or brushing hair a more pleasant, less tiring process, with hairstyling tools the handles of which are specifically adapted to ease the stress on the hand of the user.

SUMMARY OF THE INVENTION

The present invention relates to hairstyling tools comprising a head containing one or more elements adapted for combing or brushing of hair, and a handle surrounded radially by a material deformable by a user's fingers or hand. In a preferred embodiment, the handle is surrounded by a gel- or putty-like material which responds to the pressure of the user's hand in such a way as to either temporarily or substantially permanently conform to the grip of the user.

DETAILED DESCRIPTION OF THE INVENTION

Figure 1:
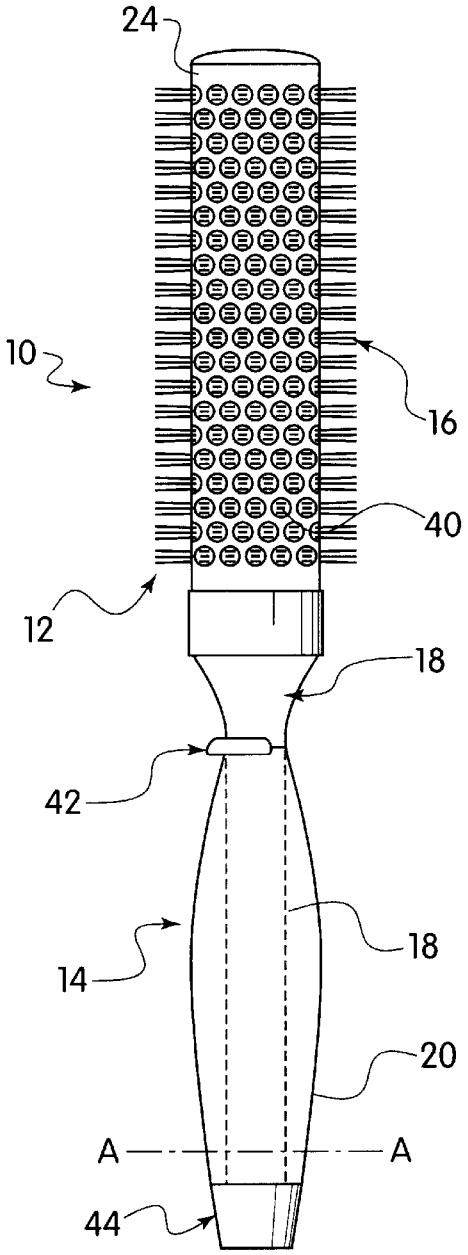
FIG. 1 shows a front elevational view of the brush of the invention, particularly showing the modified handle of the invention.

A typical hairbrush is composed of a body that is divisible visibly into two opposite ends, one end being designated as the head, carrying the bristles or other brushing or combing members, and the opposite end being adapted into a handle shape to permit gripping and ease of movement of the brush by the hand of the user. The body is frequently composed of plastic or wood, but may also be composed of metal, or a combination of metal with one of the other materials. These materials are typically hard on the hand of the user. The brush of the invention possesses these typical brush elements, but also exhibits the further improvement of a modification of the handle which permits the user to utilize the brush over long periods of time without tiring or causing pain to the hands. In particular, a unique feature of the brush is the presence, over the handle portion of the brush, of a deformable grip that responds to the pressure of the user's hand and changes shape either temporarily or permanently, depending upon the composition of the grip. Grips of this type have been disclosed, for example, in U.S. Pat. No. 5,000,599, the contents of which are incorporated herein by reference. However, the grips have, to Applicant's knowledge, only been disclosed for use on writing implements, and not for hair brushes.

The grip of the invention is formed of a material with a substantial degree of elasticity, having a gel-like feel in the hand. The grip can be, for example, a deformable solid rubber or deformable solid plastic sleeve that is slipped over the handle of the brush. In a preferred embodiment, however, the grip comprises an outer sleeve of thin deformable rubber or plastic, surrounding an inner layer of an internal viscous deformable medium, all surrounding the stem of the hair brush handle. Examples of the internal deformable medium include putty-like vinyl elastomers and or silicone-based materials, such as the material referred to as Silly Putty (Dow Chemical). Such materials have a great deal of elasticity, but are slow to return to the original shape, so that the user's particular custom grip is retained for a short period of time, but eventually can be used by others, at which time a new custom grip will be temporarily imprinted. Alternatively, the grip may be an extrusion defining an outer resilient sleeve connecting to inner radially extending webs, that in turn communicate with a smaller diameter inner sleeve that fits about the stem of the brush. The cooperation of the sleeves with the webs forms a plurality of chambers, which receive and contain a flowable viscous substance, such as a silicone-based lubricant or sealant. The webs contain vents that permit movement between chambers, so that when pressure is applied, the shape of the grip alters by movement of the viscous material, but when pressure is relieved, the viscous material gradually returns to its original location, and the original shape of the grip eventually returns. As a third alternative, the deformable substance may be a room temperature curable substance that, after an initial period of adaptation to the user's custom grip, retains that custom conformation. Examples of useful materials for that purpose include room temperature curable silicone-based substances or the like that are initially activated by exposure to heat, air or other appropriate stimuli. In addition, the grip may be a sleeve forming a bladder, within which is contained the viscous material of choice.

An exemplary brush of the invention is shown in FIG. 1. As shown therein, the brush 10 generally comprises a head region 12, and a handle region 14. The head region 12 further contains a plurality of bristles 16. The handle region comprises an inner stem 18, which is then surrounded generally by the outer deformable grip 20.

Figure 2:
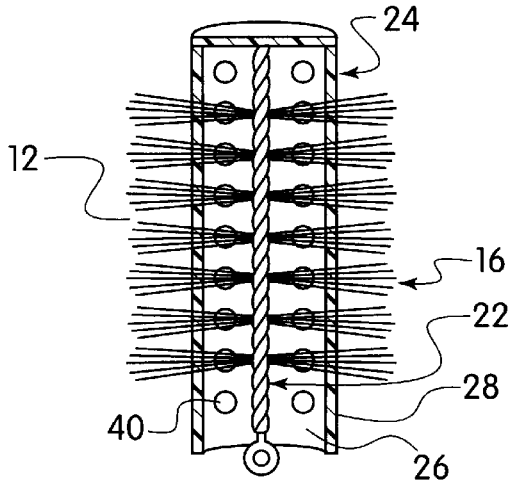
FIG. 2 shows a fragmented perspective view illustrating a portion of the head of the brush

The head region 12 and the inner stem 18 can be a unitary body formed of a single continuous material such as wood or plastic. In another embodiment, the head region 12 and the stem 18 are formed as separate entities, of the same or different materials, and are subsequently snapped or otherwise held together. In a preferred embodiment, and as shown in greater detail in FIG. 2, the head region 12 comprises a separate central twisted metal wire core 22 carrying an array of bristles 16 inserted along at least a portion of its length. Over the core is then. slipped a thin metal shell 24 having an inner surface 26 and an outer surface 28, the shell carrying a plurality of perforations 40. Properly configured, the length of the bristles 16 and the dimensions of the shell 24 are chosen so that the bristles extend through the perforations 40 of the shell 24, reaching past the outer surface 28 of the shell 24.

Figure 3:
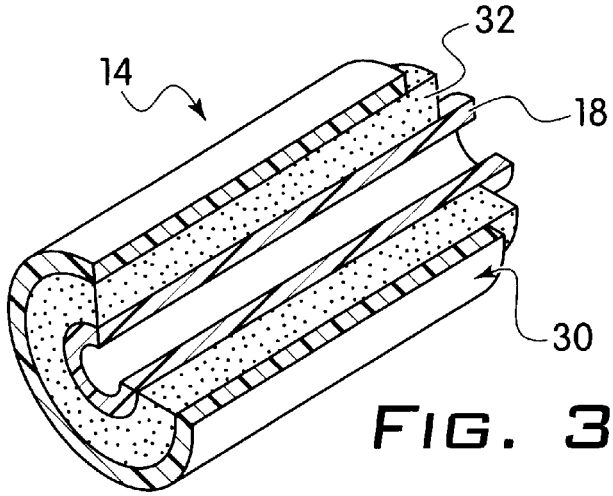
FIG. 3 shows a fragmented perspective view illustrating a portion of the handle of the brush.
Figure 4:
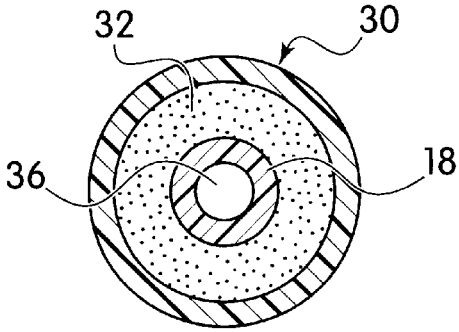
FIG. 4 shows a cross section through line A—A of FIG. 1, in an embodiment with grip composed of a single outer sleeve layer enclosing a viscous material.
Figure 5:
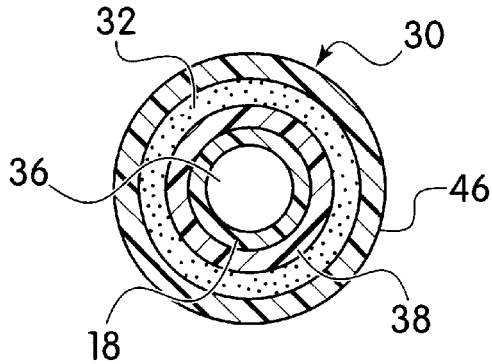
FIG. 5 shows a cross section through line A—A of FIG. 1 in an embodiment with a grip composed of a sleeve with an outer layer and inner layer surrounding the viscous material.
Figure 6:
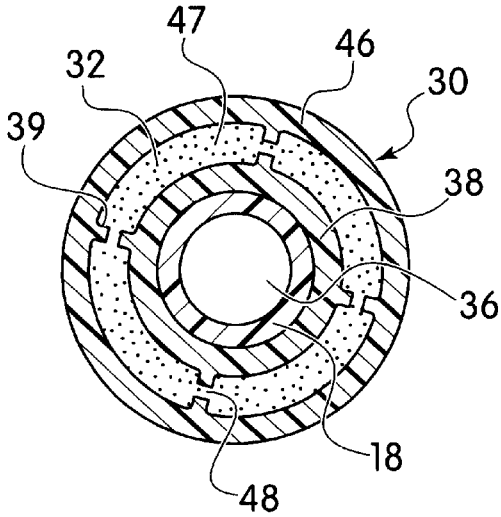
FIG. 6 shows a cross section through line A—A of FIG. 1 in an embodiment with a grip composed of a sleeve with an outer layer and inner layer integrally formed with radially interconnecting webs defining chambers surrounding the viscous material, the webs containing vents permitting the passage of the viscous material from one chamber to another.

In the aforementioned embodiment, the shell 24 with its enclosed bristles 16 and wire core 22 are inserted into a stem 18. In the embodiment disclosed in the following figures, the stem is hollow, but generally speaking, the stem can be formed of any material typically used for hairbrush handles, usually plastic or wood, and may be. either solid or hollow. The stem 18 is surrounded by a deformable grip 20. At the point at which the upper end of the grip contacts the stem, an optional cuff 42 is added over the joining point, and further, an optional cap 44 is added to finish off the bottom of the stem. One possible arrangement of the components of the grip is shown in FIG. 3. The outer portion of the grip is formed by a thin resilient sleeve 30, encasing a viscous material 32, directly surrounding the stem 18. FIG. 4 shows a cross-section of the stem in this embodiment, wherein the sleeve 30 forms the outermost layer of the grip, surrounding the viscous material 32 and the innermost stem 18, with a central cavity 36. FIG. 5 illustrates an embodiment in which the grip 20 is formed by a sleeve 30 comprising an outer layer 46 separated from an inner layer 38 by the viscous material 32, the inner layer 38 directly surrounding the stem 18. FIG. 6 shows an alternative arrangement of the sleeve of FIG. 5, in which the inner layer 38 and the outer layer 46, are part of a single extrusion, and are connected by radially directed webs 39, which define individual chambers 47 in which the viscous material 32 resides. Each web is equipped with vents 48, permitting movement of the viscous material from one chamber to another, in response to pressure on the sleeve 30.

Although the figures provided herein illustrate a substantially cylindrical brush, it will be recognized that any configuration of brush can be fitted with the grip of the invention. For example, the body of the brush can be flat rather than cylindrical, and the shape of the head and handle can be varied, for example, the head can be square, rectangular, oval or any other convenient shape, as can the handle. It will also be recognized that although the present illustrations show a brush formed of separate head and handle elements, the brush of the invention can be formed as a single piece from the same material, with bristles directly attached to the head of the brush.

What is claimed is:

1. A hairbrush comprising a head and a handle, the head comprising:

a twisted metal wire core carrying an array of bristles inserted along at least a portion of the length of the core; and a shell containing a plurality of perforations, the shell positioned over the bristle-carrying core, the perforations dimensioned and positioned so as to permit the bristles to pass through the perforations;

the handle comprising a stem and a deformable grip;

the grip comprising:

a outer layer in the form of a resilient sleeve surrounding the stem; and a deformable viscous material positioned between the stem and the resilient sleeve.

2. The hairbrush of claim 1 in which the grip further comprises an inner layer positioned between the stem and the viscous material.

3. The hairbrush of claim 2 in which the viscous material is a putty.

4. The hairbrush of claim 3 in which the viscous material is a vinyl elastomer or silicone putty.

5. The hairbrush of claim 2 in which the grip further comprises radially oriented webs that connect the inner and outer layers thus forming chambers which contain the viscous material, each web having at least one vent dimensioned so as to permit the passage of the viscous material from one chamber to another chamber when pressure is placed on the grip.

6. The hairbrush of claim 5 in which the viscous material is a flowable substance.

7. The hairbrush of claim 6 in which the viscous material is a silicone lubricant.

8. The hairbrush of claim 7 in which the viscous material is a room-temperature curable substance.

* * * * *